United States Patent [19]

Thompson

[11] 4,016,662

[45] Apr. 12, 1977

[54] SHOE CONSTRUCTION

[76] Inventor: Charles Thompson, 745 Pennsylvania Ave., Brooklyn, N.Y. 11207

[22] Filed: Aug. 3, 1976

[21] Appl. No.: 711,241

[52] U.S. Cl. ..... 36/29

[51] Int. Cl.[2] ..... A43B 13/20

[58] Field of Search ..... 36/29, 44

[56] References Cited

UNITED STATES PATENTS

| | | | |
|---|---|---|---|
| 580,501 | 4/1897 | Mobberley | 36/29 |
| 1,010,187 | 11/1911 | Scott | 36/29 |
| 1,506,975 | 9/1924 | Cooney | 36/29 |
| 2,037,230 | 4/1936 | Hack | 36/29 |
| 2,605,560 | 8/1952 | Gouabault | 36/29 |
| 2,981,010 | 4/1961 | Aaskov | 36/29 X |
| 3,120,712 | 2/1964 | Menkin | 36/29 |

*Primary Examiner*—Alfred R. Guest
*Attorney, Agent, or Firm*—Robert D. Farkas

[57] ABSTRACT

This disclosure pertains to a shoe construction in which a sack is disposed within a cavity formed between the inner and outer sole of a shoe. An air valve may extend through the side walls of the cavity permitting the sack to be filled with a fluid. Selective portions of the insole are fixedly secured with the abutting surface of the sack so as to provide stiffer foot supporting areas thereat than adjacent unsecured areas.

7 Claims, 4 Drawing Figures

FIG. 1
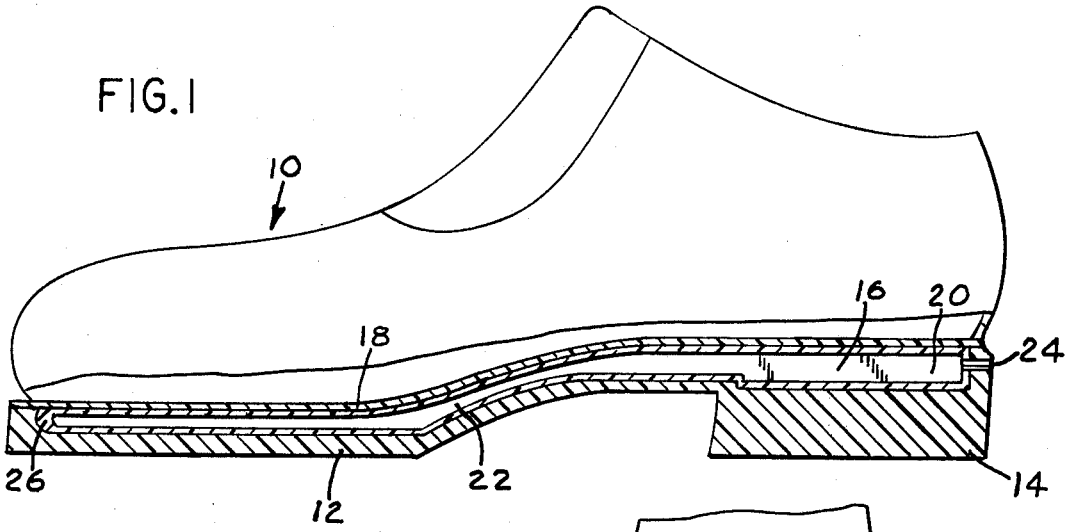
FIG. 2
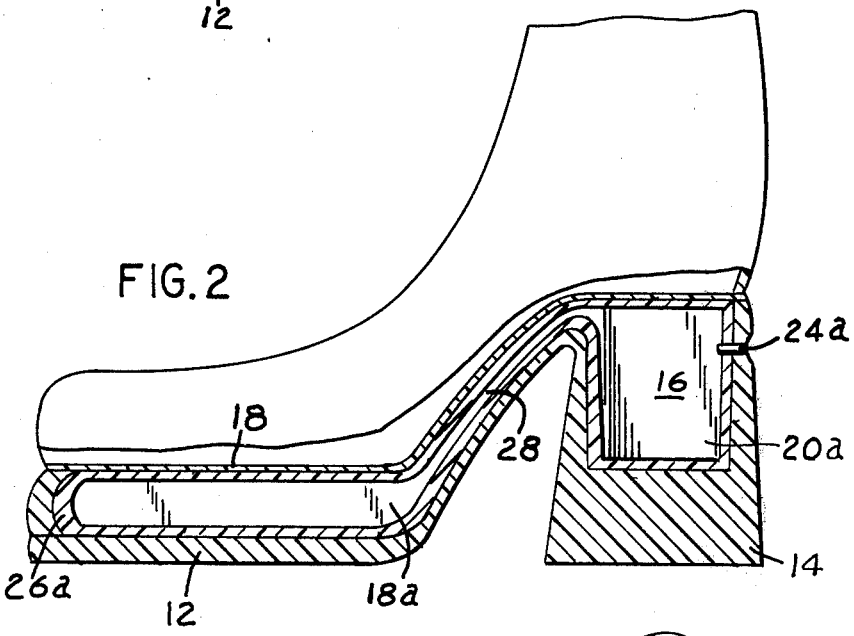
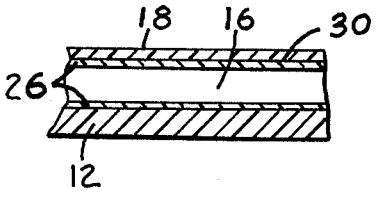
FIG. 3
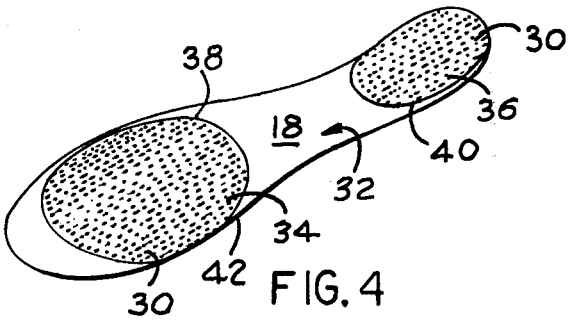
FIG. 4

SHOE CONSTRUCTION

BACKGROUND OF THE INVENTION

1. Field of the Invention

This invention relates to footwear apparatus and more particularly to that class utilizing sacks for fluidly supporting the user thereof.

2. Description of the Prior Art

The prior art abounds with devices adapted to provide an air cushion supporting the foot of the user attached to footwear. U.S. Pat. No. 2,981,010 issued on Apr. 25, 1961 to H. Aaskov teaches an air filled sandal having a plurality of compartments residing between the inner sole and outer sole. Each compartment communicates with the other compartments and is inflated by way of a valve communicating thereinto.

U.S. Pat. No. 3,120,712 issued on Feb. 11, 1964 to L. L. Menken discloses a sack disposed intermediate opposed surfaces of an insole and an outer sole. A rigid stiff member is affixed to the lowermost surface of the insole and rests upon the uppermost surface of the sack. The marginal edges of the stiff member approximate the innermost walls of the cavity in which the sack resides but are free from touching engagement therewith. Thus, the user's foot comes into contact with a substantially uniformly stiff member, freely floating upon the sack filled with a fluid.

The aforementioned patents suffer the common deficiency of providing a resting surface which, though cushioned by fluid pressure, is either uniformly stiff or uniformly responsive to changes in the level of pressure of the fluid utilized.

SUMMARY OF THE INVENTION

A primary object of the present invention is to provide a foot supporting surface which is air cushioned.

Another object is to provide discrete areas of the insole of a shoe used to support the weight supporting areas of a foot having a stiffer construction than other areas of the insole which contact non-weight supporting areas of the sole of the foot.

Still another object is to provide a sack which may be filled with a pressurizing fluid having a self-closing filling valve affixed thereto.

Yet another object is to provide a sack compatibly installed within shoes of conventional design which results in selective areas of the insole having selected amounts of stiffness.

Previous efforts to adapt shoes with soft cushionable materials designed to increase the comfort of the user have failed because the resilient materials employed tend to become less resilient after prolonged periods of use. Thus the insole takes a set, which is permanent in nature and though accommodating the contours of the sole of the user, is no longer effective in providing a soft resilient cushioned effect. In an effort to overcome this problem, air cushions have been used, notably in the form of sacks, installed intermediate the innermost and outermost soles of the shoe. However, such constructions have failed to become commercially successful because those areas of the insole tending to provide support to portions of the foot of the user carrying the bulk of the user's weight, after a while, became "worked" and lost the original stiffness provided by the insole material.

Attempts to provide a very stiff supporting plate, freely floating on the undersurface of the insole, resulted in a shoe whose insole was non-conforming to the contours of the user's foot and oppressively hard to areas of the foot supported by it.

The present invention utilizes stiff areas below the heel portion and ball portion of the sole of the foot of the user by selectively bonding together areas of the insole and areas of the sack contacting the insole therebelow. This apparatus results in two major support areas, each mechanically separated from one another except by the dynamic fluid pressure of the fluid within the sack. The remaining areas of the insole which are less stiff, are similarly supported by the pressure within the sack and are free to contact remaining portions of the sole of the user to an extent limited only by the stiffness of the insole alone being operated on by a deformed portion of the sack therebelow.

These objects, as well as other objects of the present invention, will become more readily apparent after reading the following description of the accompanying drawings.

BRIEF DESCRIPTION OF THE DRAWINGS

FIG. 1 is a side elevation view of the present invention;

FIG. 2 is a side elevation view of a variant form of the present invention;

FIG. 3 is a cross-sectional side elevational view of a portion of the apparatus depicted in FIG. 1; and FIG. 4 is a plan view of the underside portion of the insole utilizing the present invention.

DESCRIPTION OF THE PREFERRED EMBODIMENT

The structure and method of fabrication of the present invention is applicable to a shoe having an inner sole and an outer sole. The marginal edges of both soles are joined together by walls creating a cavity between opposed lateral surfaces of the inner sole and outer sole. The cavity may have height variations dependent upon the location along the length of the shoe. Preferably, the cavity height will be substantially higher in the area comprising the heel portion of the shoe so as to provide a cavity enclosing a greater volume of space without requiring the insole to be elevated substantially above its normal height level over the outer sole. The cavity houses a sack preferably fabricated from a rubber or rubber-like material molded so as to conform substantially with the interior surfaces of the cavity. A filling port similar to a self closing valve, passes through a portion of the side walls of the shoe adjacent the cavity and communicates to the interior portions of the sack. The filling port is preferably disposed entering the heel portion of the cavity and located beneath the counter area of the shoe.

A portion of the undersurface of the insole is fixedly secured to a portion of the uppermost surface of the sack directly beneath the ball of the foot of the user. Another area of the insole, directly beneath the heel of the foot of the user, is similarly secured to the sack. Both secured areas possess a flexibility substantially less than the flexibility of each uncombined material below other areas of the sole of the foot of the user. Assuming that the material comprising the sack is the same as the material making up the insole, the flexibility of a combined area is four times greater than the flexibility of an uncombined area. An adhesive layer applied to the selected areas aforementioned successfully combines preferential areas of the insole to preferential areas of the sack. These more rigid, less flexible areas, may extend, abutting the side walls of the cavity so as to minimize their ability to "free-float" in the vertical direction. Alternatively, maintaining the edges of the combined areas inwardly from the side walls of the cavity permits the stiffened combined areas to more readily respond to fluid pressure variations of the fluid within the sack.

Now referring to the Figures, and more particularly to the embodiment illustrated in FIG. 1 showing the present invention 10 having an outer sole 12 and a heel portion 14. Cavity 16 is disposed beneath inner sole 18 and outer sole 12 and is shown having a greater height at point 20 located within heel 14, as opposed to point 22, located below the vamp of the shoe. Filling port 24 communicates from the exterior surface of the shoe into sack 26 residing within cavity 16, being molded to conform with the shape thereof.

FIG. 2 is an alternate embodiment to that shown in FIG. 1 having a heel portion at point 20*a* whose height is substantially greater than the height of the cavity at point 18*a*, point 28 having a height less than the height of point 18*a*. Though port 24*a* communicates to sack 26*a*, other embodiments of the present invention may include sacks devoid of filling ports, which when initially fabricated, maintain the fluid, such as air, initially contained therewithin.

FIG. 3 illustrates in cross-section, portions of the apparatus depicted in FIG. 1 including outer sole 12, inner sole 18, uppermost and lowermost portions of sack 26, and an adhesive layer 30 joining inner sole 18 to the uppermost layer of sack 26.

FIG. 4 illustrates innersole 18, as shown in FIG. 1, having a lowermost surface 32 of which selected areas 34 and 36 thereof are covered by adhesive layer 30, shown in FIG. 3. Selected area 34 is bounded by marginal edges 38 whilst selected area 36 is bounded by marginal edges 40, confining the location of the adhesive areas. Marginal edge 42 defines the peripheral edge of insole 18. Though marginal edges 38 and 40 are shown inwardly located from marginal edge 42, alternate embodiments may include portions of marginal edges 38 and 40 being disposed congruently with portions of marginal edge 42. It is to be noted that areas 34 and 36 as shown, correspond with the ball and heel areas of the foot. Alternate embodiments may include additional adhesive areas, such as falling under the outermost side portions of the soles of the feet interconnecting or adjacent to the ball and heel areas of the sole of the feet.

One of the advantages is to provide a foot supporting surface which is air cushioned.

Another advantage is to provide discrete areas of the insole of a shoe used to support the weight supporting areas of a foot having a stiffer construction than other areas of the insole which contact non-weight supporting areas of the sole of the foot.

Still another advantage is to provide a sack compatibly installed within shoes of conventional design which results in selective areas of the insole having selected amounts of stiffness.

Thus, there is disclosed in the above description and in the drawings, an embodiment of the invention which fully and effectively accomplishes the objects thereof. However, it will become apparent to those skilled in the art, how to make variations and modifications to the instant invention. Therefore, this invention is to be limited, not by the specific disclosure herein, but only by the appending claims.

The embodiment of the invention in which an exclusive privilege or property is claimed are defined as follows:

I claim:

1. A shoe construction comprising an upper portion attached to an innersole, an outer sole and a heel beneath said innersole or wall located between said soles and between said innersole and said heel about the peripheries thereof defining an enclosed cavity between said soles and between said innersole and said heel, a hollow flexible sack located with said cavity, a pressurized fluid within said sack, at least two separated areas of said inner sole being fixedly secured to adjacent abutting areas of said sack, the remaining areas of said inner sole being disposed unfastened to said sack.

2. The shoe construction as claimed in claim 1 wherein said at least two areas have longitudinal and transverse dimensions less than the corresponding dimensions of said cavity whereby said at least two areas are free of attachment with said wall and are free to move relative to said wall and relative to each other.

3. The shoe construction as claimed in claim 1 wherein one of said at least two areas resides beneath the ball of the foot of the user of said shoe, the other of said at least two areas being disposed residing beneath the heel of said user.

4. The shoe construction as claimed in claim 1 wherein said at least two areas have longitudinal dimensions less than the corresponding dimensions of said cavity whereby a portion of said at least two areas are attached to said wall, said at least two areas being free to move relative to one another.

5. The shoe construction as claimed in claim 1 further comprising said cavity having a greater height intermediate said innersole and said heel than the height thereof intermediate said soles.

6. The shoe construction as claimed in claim 5 wherein said height intermediate said soles is non-uniform along said longitudinal dimensions of said inner sole.

7. The shoe construction as claimed in claim 1 wherein said sack having outermost surfaces substantially conforming with the internal contours of said innersole and said outer sole and said heel and said wall.

* * * * *